US010636605B2

(12) United States Patent
Onoda et al.

(10) Patent No.: US 10,636,605 B2
(45) Date of Patent: Apr. 28, 2020

(54) FUSIBLE LINK UNIT

(71) Applicant: YAZAKI CORPORATION, Tokyo (JP)

(72) Inventors: Shinya Onoda, Shizuoka (JP); Naoya Akiyama, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/144,854

(22) Filed: May 3, 2016

(65) Prior Publication Data

US 2016/0247654 A1 Aug. 25, 2016

Related U.S. Application Data

(63) Continuation of application No. PCT/JP2014/079394, filed on Nov. 6, 2014.

(30) Foreign Application Priority Data

Nov. 7, 2013 (JP) ..... 2013-231136

(51) Int. Cl.
*H01H 85/02* (2006.01)
*H01H 85/20* (2006.01)

(52) U.S. Cl.
CPC .... *H01H 85/0241* (2013.01); *H01H 85/2045* (2013.01); *H01H 2085/025* (2013.01); *H01H 2223/044* (2013.01)

(58) Field of Classification Search
CPC ..... H01H 85/0241; H01H 85/20; H01H 2223/044; H01H 2085/025; H01H 9/0264; H01H 85/25; H01H 9/22; H01T 13/06

(Continued)

(56) References Cited

U.S. PATENT DOCUMENTS 6,512,443 B1 * 1/2003 Matsumura ..... H01H 85/044 337/161
2001/0046624 A1 * 11/2001 Goto ..... H01M 2/105 429/99

(Continued)

FOREIGN PATENT DOCUMENTS

JP 2002-270082 A 9/2002
JP 2009-056992 A 3/2009

(Continued)

OTHER PUBLICATIONS

Hishinuma, Shoji, Shield Cover, Apr. 18, 2013, Toyota Motor Corp, Entire Document (Translation of JP 2013069828).*

(Continued)

*Primary Examiner* — Jayprakash N Gandhi
*Assistant Examiner* — Stephen S Sul
(74) *Attorney, Agent, or Firm* — Metrolex IP Law Group, PLLC

(57) ABSTRACT

A fusible link unit (1) includes a battery (5) with a battery post (3) projecting on an upper surface of the battery (5), a fuse unit (9) arranged on the upper surface of the battery (5) and having a battery terminal (7) connected to the battery post (3), and a fuse cover (11) covering an outer circumference of the fuse unit (9). A deck board (13) is arranged above the fuse cover (11) so as to be capable of being opened and closed. The fuse cover (11) is fixed by being held between the battery (5) and the deck board (13) in a closed state of the deck board (13).

16 Claims, 5 Drawing Sheets

(58) Field of Classification Search
USPC ..... 337/187, 20, 34, 186, 398, 414, 208
See application file for complete search history.

(56) References Cited

U.S. PATENT DOCUMENTS

| | | | | |
|---|---|---|---|---|
| 2002/0134572 | A1* | 9/2002 | Matsumura | H01H 85/044 174/66 |
| 2002/0163416 | A1* | 11/2002 | Matsumura | H01H 85/044 337/112 |
| 2007/0123105 | A1* | 5/2007 | Tsukashima | H01R 13/595 439/607.41 |
| 2009/0061291 | A1* | 3/2009 | Ohashi | B60R 16/04 429/65 |
| 2015/0299988 | A1* | 10/2015 | Abe | B60R 25/2063 180/315 |

FOREIGN PATENT DOCUMENTS

| | | | |
|---|---|---|---|
| JP | 2013-069828 | A | 4/2013 |
| JP | 2013069828 | A * | 4/2013 |

OTHER PUBLICATIONS

Hishinuma Shoji; Nakagawa Daisuke, "Shield Cover", Apr. 18, 2013, Toyota Motor Corp, Entire Document (Translation of JP 2013069828).*

"Battery Installation", Dec. 8, 2010, RAV4WORLD, p. 4. (Year: 2010).*

Official Action dated Aug. 8, 2017 in the counterpart Japanese patent application.

* cited by examiner

FUSIBLE LINK UNIT

CROSS REFERENCE TO RELATED APPLICATIONS

This application is a Continuation of PCT Application No. PCT/JP2014/079394, filed on Nov. 6, 2014, and claims the priority of Japanese Patent Application No. 2013-231136, filed on Nov. 7, 2013, the content of both of which is incorporated herein by reference.

BACKGROUND

Technical Field

The present invention relates to a fusible link unit to be applied to a vehicle.

Related Art

A conventionally known fusible link unit includes a battery with a battery post projecting on an upper surface of the battery, a fuse unit having a battery terminal arranged on the upper surface of the battery and connected to the battery post, and a protective cover as a fuse cover which covers an outer circumference of the fuse unit (see JP 2002-270082 A).

In the fusible link unit, the protective cover has a first cover and a second cover connected to the first cover via a rotation portion.

The first cover configuring the protective cover is provided with a lock portion having a projection portion. By engaging the projection portion of the lock portion with a recess portion provided on the fuse unit, the first cover is fixed to the fuse unit.

SUMMARY OF THE INVENTION

However, since in such a fusible link unit as described in the above Patent Literature 1, fixing of the fuse cover to the upper surface of the battery is achieved only by engagement of the lock portion of the fuse cover with the recess portion of the fuse unit, vibration due to traveling of a vehicle or the like causes a rattle of the fuse cover, so that an abnormal sound might be generated.

Thus, an object of the invention is to provide a fusible link unit which enables generation of an abnormal sound caused by vibration of a fuse cover to be prevented.

A fusible link unit according to the present invention includes a battery with a battery post projecting on an upper surface of the battery, a fuse unit arranged on the upper surface of the battery and having a battery terminal connected to the battery post, and a fuse cover covering an outer circumference of the fuse unit. A deck board is arranged above the fuse cover so as to be capable of being opened and closed. The fuse cover is fixed by being held between the battery and the deck board in a closed state of the deck board.

In this fusible link unit, since the fuse cover is fixed by being held between the battery and the deck board in a closed state of the deck board, the fuse cover will not rattle on the upper surface of the battery even when vibration of a vehicle is caused by traveling of the vehicle or the like.

Accordingly, in such a fusible link unit, because the fuse cover will not rattle on the upper surface of the battery, generation of an abnormal sound due to vibration of the fuse cover can be prevented.

The fusible link unit according to the present invention may include a fuse cover having contact surfaces formed with plane surfaces so as to be in contact with the battery and the deck board.

In this fusible link unit, because contact surfaces of the fuse cover which come into contact with the battery and the deck board are formed as a plane surface, the fuse cover can be stably fixed by surface-contact with the battery and the deck board, thereby securely preventing a rattle of the fuse cover.

According to the present invention, an effect can be produced of providing a fusible link unit which enables generation of an abnormal sound caused by vibration of a fuse cover to be prevented.

DETAILED DESCRIPTION

Figure 1:
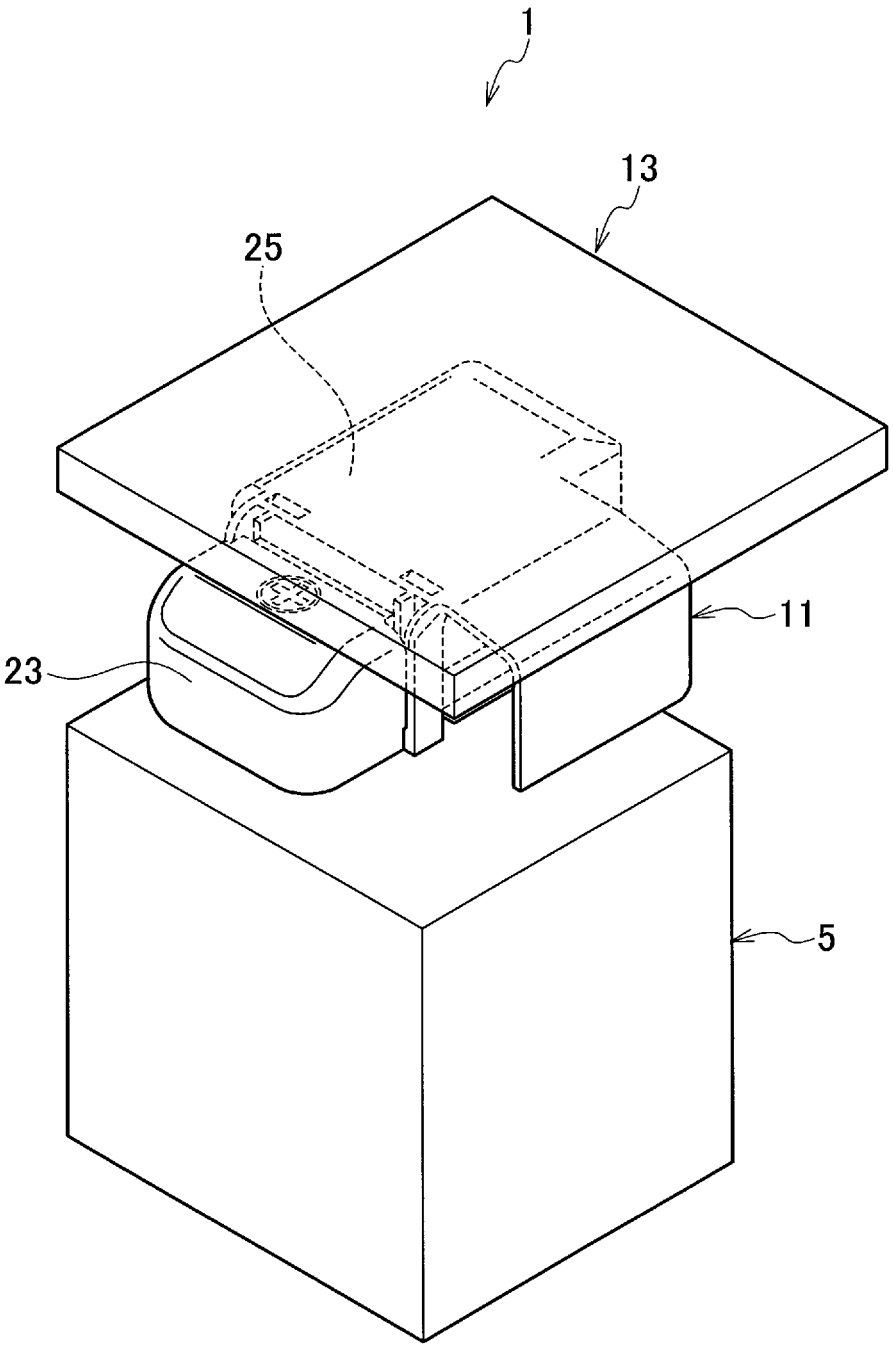
FIG. 1 is a perspective view of a fusible link unit according to an embodiment of the present invention.
Figure 2:
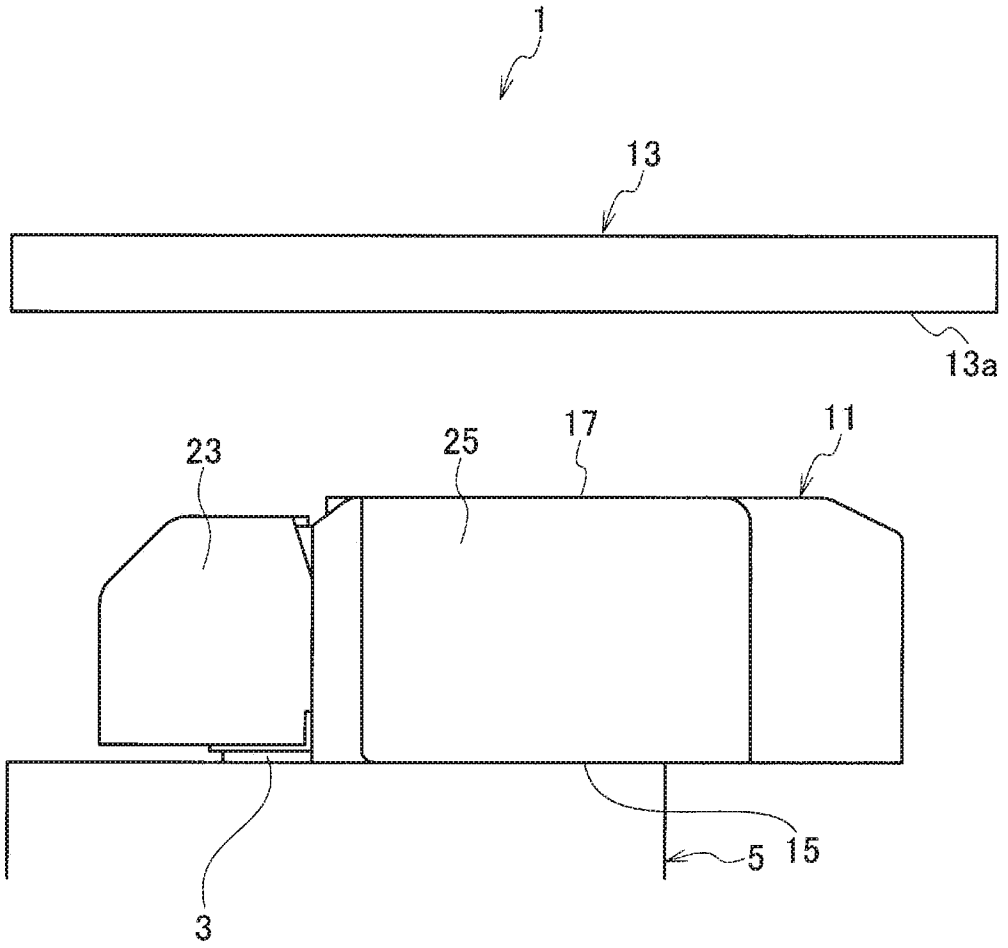
FIG. 2 is a side view of the fusible link unit with a deck board opened according to the embodiment of the present invention.
Figure 3:
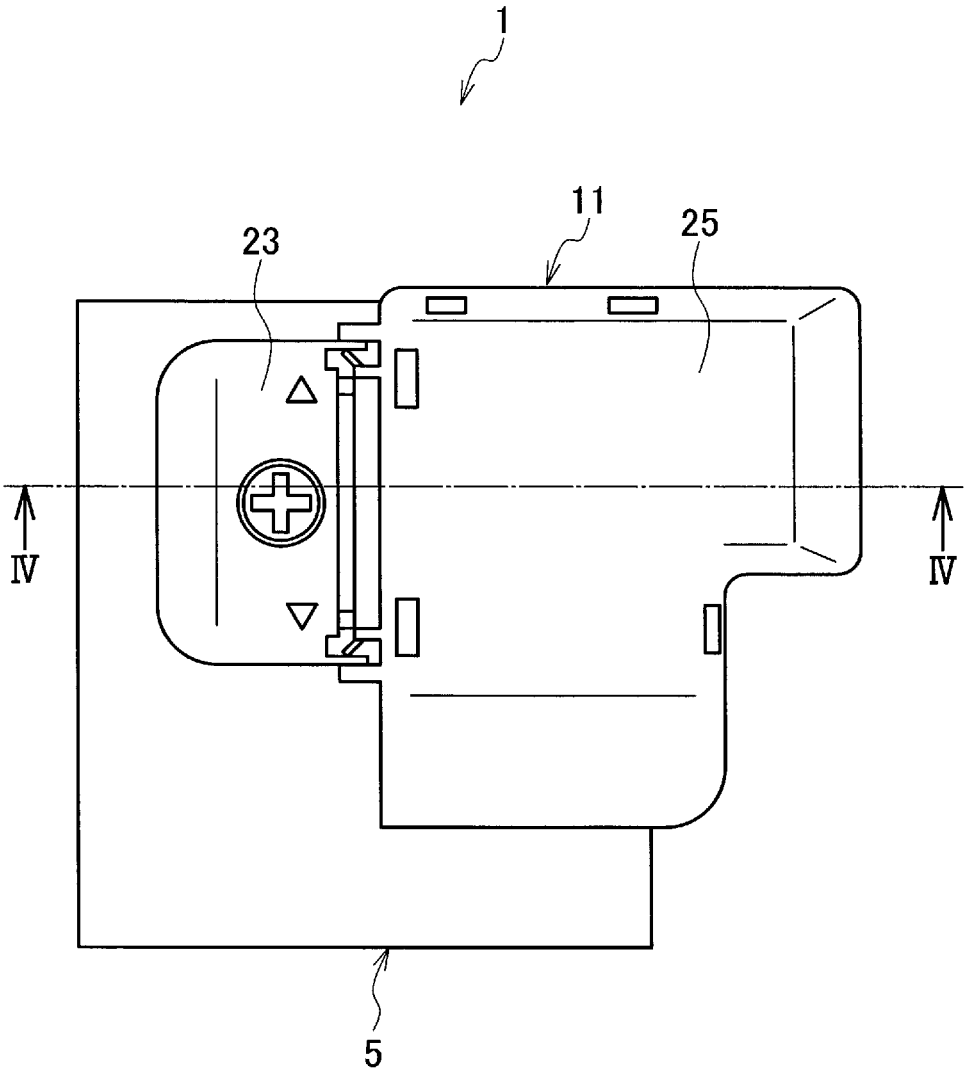
FIG. 3 is a top view of the fusible link unit according to the embodiment of the present invention.
Figure 4:
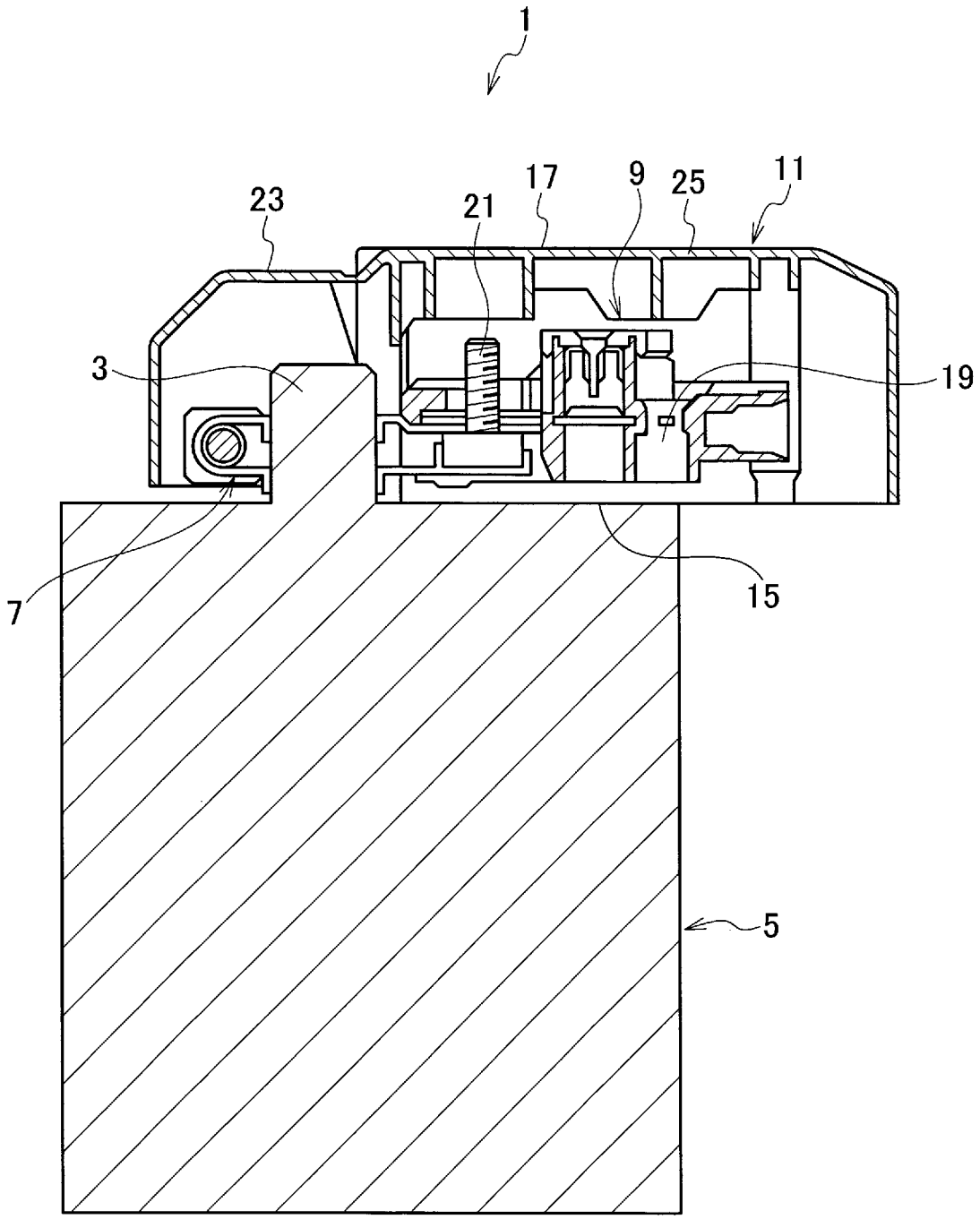
FIG. 4 is a sectional view taken along IV-IV of FIG. 3.
Figure 5:
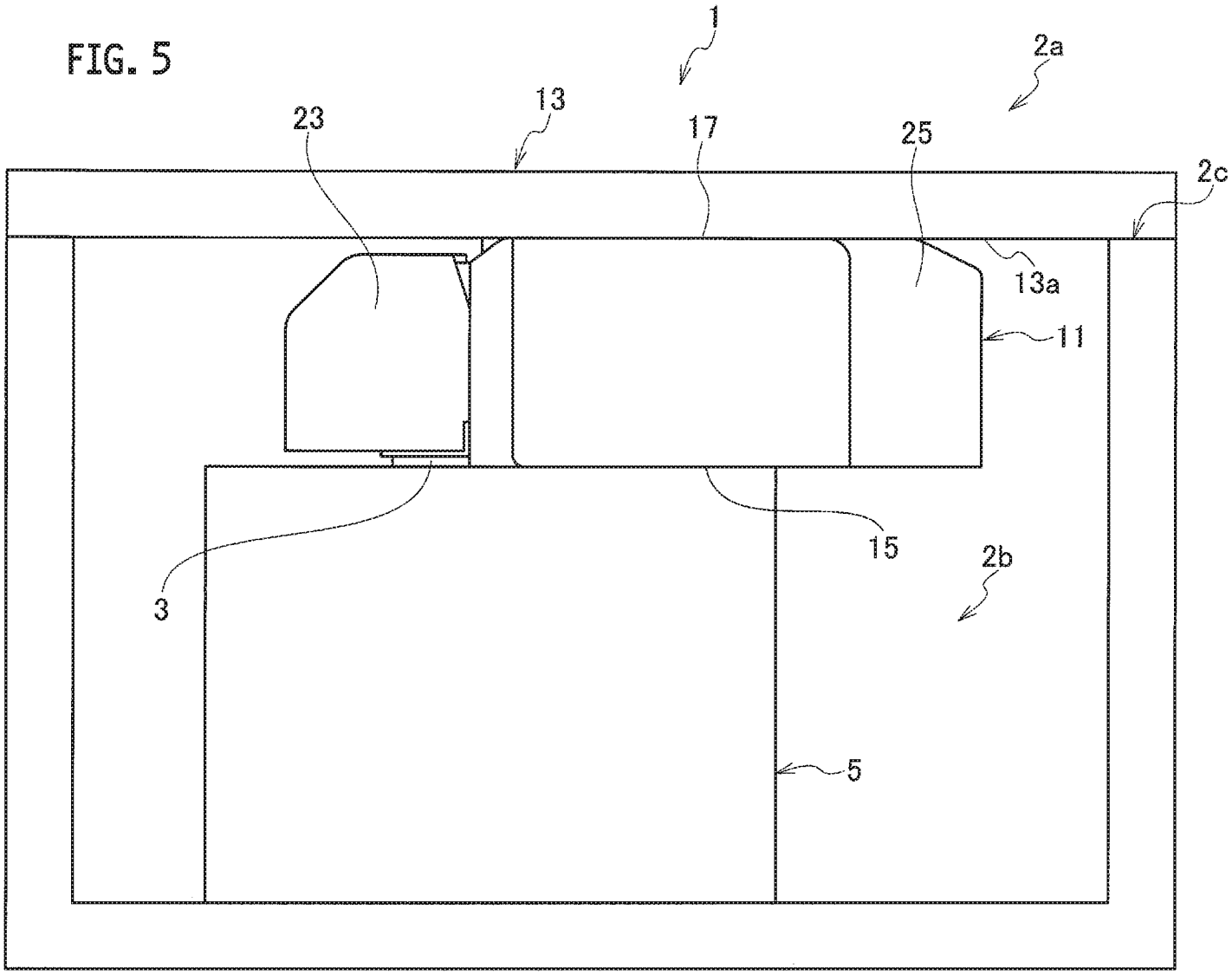
FIG. 5 is a side view of the fusible link unit with the deck board closed according to the embodiment of the present invention.

A fusible link unit according to an embodiment of the present invention will be described with reference to FIGS. 1 to 5.

A fusible link unit 1 according to the present embodiment includes a battery 5 having a battery post 3 projecting on an upper surface of the battery 5, a fuse unit 9 arranged on the upper surface of the battery 5 and having a battery terminal 7 connected to the battery post 3, and a fuse cover 11 which covers an outer circumference of the fuse unit 9.

Additionally, above the fuse cover 11, a deck board 13 is arranged to be capable of being opened and closed.

Then, with the deck board 13 closed, the fuse cover 11 is fixed by being held between the battery 5 and the deck board 13.

Additionally, in the fuse cover 11, contact surfaces 15, 17 which come into contact with the battery 5 and the deck board 13 are formed as a plane surface.

Here, the fusible link unit 1 is arranged between the battery 5 mounted on a vehicle and each of various kinds of equipment or the like mounted on the vehicle to supply electric power from the battery 5 to the equipment or the like.

As illustrated in FIGS. 1 to 5, the battery 5 is formed to be a rectangular solid and has the battery post 3 projecting on the upper surface of the battery 5. The battery terminal 7 of the fuse unit 9 is fixed to the battery post 3.

In the fuse unit 9, a fuse element 19, which is made of a conductive material and is provided with a fuse that fuses due to overcurrent, is molded with a synthetic resin, and the fuse element 19 is electrically connected to the battery terminal 7.

The battery terminal 7 is made of a conductive material. At one end of the battery terminal 7, a battery connection portion, which is formed of a hole into which the battery post 3 is inserted for electrical connection, is provided, and at the other end, a stud bolt 21 is provided to project in a direction upward from the upper surface of the battery 5.

The battery terminal 7 is fixed to the battery 5 by fastening the bolt, with the battery connection portion inserted into the battery post 3. To the stud bolt 21 of the battery terminal 7 thus fixed to the battery 5, the fuse element 19 is connected.

To the fuse unit 9, a connector, which is provided at a terminal portion of electric wires connected to various kinds of equipment or the like mounted on the vehicle, is connected. Then, the fuse unit 9 supplies electric power from the battery 5 to various kinds of equipment or the like. On this occasion, when overcurrent is applied to the fuse element 19, the fuse fuses to cut off electric power supply between the battery 5 and various kinds of equipment or the like.

In such fuse unit 9, the fuse cover 11 is arranged so as to cover the outer circumference of the unit. The fuse cover 11 protects the fuse unit 9.

The fuse cover 11 is made of an insulative material such as a synthetic resin and includes a cover portion 23 and a main body portion 25. The cover portion 23 is arranged on the upper surface of the battery 5 so as to mainly cover the battery post 3 of the battery 5 and the battery terminal 7 of the fuse unit 9. The cover portion 23 is coupled to the main body portion 25 to be capable of being opened and closed via a hinge.

The main body portion 25 is arranged on the upper surface of the battery 5 so as to mainly cover the fuse unit 9. Here, the fuse unit 9 is arranged, on the upper surface of the battery 5, so as to protrude from a side surface of the battery 5 due to wires for the connection with various kinds of equipment or the like.

Therefore, the main body portion 25 covering the fuse unit 9 is also arranged, on the upper surface of the battery 5, so as to protrude from the side surface of the battery. Above such fuse cover 11, the deck board 13 is arranged.

The deck board 13 is provided at the upper side of the fuse cover 11 so as to be capable of being opened and closed. The deck board 13 is a design member which is arranged, for example, in a vehicle room 2*a* to section a housing space 2*b* on the battery 5 side and the vehicle room 2*a* of the inside of the vehicle and which blocks the housing space 2*b* on the battery 5 side. Additionally, in the vehicle room 2*a*, the housing space 2*b* on the battery 5 side, for example, a recess portion with an open upper part to house the battery 5, is formed, and the deck board 13 is mounted so as to cover the housing space 2*b*. On this occasion, the deck board is supported at a peripheral portion 2*c* of the housing space 2*b* of the battery 5. When the battery 5 is housed in the housing space 2*b* on the battery 5 side, the fuse cover 11 is on the same level of a plane on which no recess portion is formed in the vehicle room 2*a*, so that a lower surface of the deck board comes into contact with the fuse cover 11.

The deck board 13 being capable of being opened and closed represents a structure in which it is provided to be capable of being opened and closed on the vehicle side so as to be detachable without using a coupling portion, a structure in which it is provided to be capable of being opened and closed on the vehicle side via a coupling portion, or the like. A state where the deck board 13 is closed represents a state where the lower surface of the deck board 13 and the contact surface 17 of the fuse cover 11 are in contact with each other when the fuse cover 11 is covering the fuse unit 9 arranged on the upper surface of the battery 5. A state where the deck board 13 is opened represents a state where the deck board 13 is apart from the fuse cover 11 and a space above the fuse cover 11 arranged on the upper surface of the battery 5 is open.

Between such deck board 13 and battery 5, the fuse cover 11 is arranged. With the deck board 13 closed, the fuse cover 11 is fixed by being held between the upper surface of the battery 5 and the lower surface of the deck board 13.

By fixing and holding the fuse cover 11 between the upper surface of the battery 5 and the lower surface of the deck board 13, the fuse cover 11 can be fixed on the upper surface of the battery 5 without rattling. Therefore, even when vibration is caused in the vehicle due to traveling of the vehicle or the like, the fuse cover 11 will not rattle, thereby preventing generation of an abnormal sound.

In addition, in the fuse cover 11, the contact surfaces 15, 17, which come into contact with the battery 5 and the deck board 13, are formed as a plane surface. Thus forming the contact surfaces 15, 17 to be plane obtains a surface-contact, so that a supporting area of the fuse cover 11 can be increased to stabilize fixing of the fuse cover 11.

The lower surface of the deck board 13 which comes into contact with the fuse cover 11 may be formed of a buffer material 13*a*. Forming the lower surface of the deck board 13 with a buffer material 13*a* can prevent rattling and generation of an abnormal sound, and can protect the fuse cover 11 from being damaged by buffering a pressure on the fuse cover 11 side from the upper surface of the deck board 13. Additionally, even when a rattle is caused by vibration, damage of the fuse cover 11 or the deck board 13 can be suppressed at a contact part between the contact surface 17 of the fuse cover 11 and the deck board 13.

Here, since the fuse unit 9 and the fuse cover 11 are arranged to be overhung on the upper surface of the battery 5 so as to protrude from the side surface of the battery 5, when the fuse cover 11 rattles largely, a load applied to the battery post 3 of the battery 5 is increased, so that the battery post 3 might be deformed.

However, since in the fusible link unit 1 according to the present embodiment, the fuse cover 11 is fixed by being held between the battery 5 and the deck board 13, the fuse cover 11 will not rattle on the upper surface of the battery 5, so that a load applied to the battery post 3 can be drastically reduced to prevent deformation of the battery post 3.

In such fusible link unit 1, since with the deck board 13 closed, the fuse cover 11 is fixed by being held between the battery 5 and the deck board 13, the fuse cover 11 will not rattle on the upper surface of the battery 5 even when vibration is caused in the vehicle due to traveling of the vehicle or the like.

Accordingly, in such fusible link unit 1, since the fuse cover 11 will not rattle on the upper surface of the battery 5, generation of an abnormal sound caused by vibration of the fuse cover 11 can be prevented.

Additionally, since in the fuse cover 11, the contact surfaces 15, 17, which come into contact with the battery 5 and the deck board 13, are formed as a plane surface, the fuse cover 11 can be stably fixed by a surface-contact with the battery 5 and the deck board 13, thereby securely preventing the fuse cover 11 from rattling.

While in the fusible link unit according to the embodiment of the present invention, the fuse unit on the upper surface of the battery is arranged so as to protrude from the side surface of the battery, the fuse unit may not be arranged to protrude from the side surface of the battery.

In addition, while the fuse unit is formed into a shape parallel to the upper surface of the battery, it is not limited thereto, but may be arranged on the upper surface and the side surfaces of the battery to have an L-shape.

Although the embodiment of the present invention has been described heretofore, the embodiment is merely exemplified for facilitating the understanding of the present invention, and the present invention is not limited to the embodiment. The technical scope of the present invention may include not only the specific technical matters disclosed in the above-described embodiment but also various modifications, changes, and alternative techniques easily derived from the above-described specific technical matters.

What is claimed is:

1. A fusible link unit comprising:

a battery with a battery post projecting on an upper surface of the battery;

a fuse unit arranged on the upper surface of the battery and having a battery terminal so as to be connected to the battery post;

a fuse cover covering an outer circumference of the fuse unit; and a deck board arranged above the fuse cover so as to be capable of being opened and closed, wherein the fuse cover is fixed by being held between the battery and the deck board in a closed state of the deck board, wherein the battery is housed in a housing space of a vehicle room;

a planar contact surface of the deck board to be directly in contact with the fuse cover in the closed state of the deck board is formed as a plane surface; and the planar contact surface of the deck board is directly supported at a peripheral portion of the housing space and covers the housing space so as to section the housing space from the vehicle room.

2. The fusible link unit according to claim 1, wherein the fuse cover has contact surfaces formed with plane surfaces so as to be in contact with the battery and the deck board.

3. The fusible link unit according to claim 2, wherein the fuse cover, the contact surfaces in contact with the battery and the deck board comprise plane surfaces to provide surface-contact between the fuse cover, the contact surfaces in contact with the battery and the deck board, to increase a supporting area of the fuse cover and stabilize the fuse cover.

4. The fusible link unit according to claim 1, wherein the fuse unit comprises a fuse element, which is:

made of a conductive material, provided with a fuse that fuses due to overcurrent, molded with a synthetic resin, and electrically connected to the battery terminal.

5. The fusible link unit according to claim 1, wherein the battery terminal comprises:

at one end thereof, a battery connection portion, which is formed of a hole into which the battery post is inserted for electrical connection, and at the other end thereof, a stud bolt, which is provided to project in a direction upward from the upper surface of the battery.

6. The fusible link unit according to claim 5, wherein the fuse unit comprises a fuse element, the battery terminal is fixed to the battery by the stud bolt, with the battery connection portion inserted into the battery post, and the fuse element is connected to the stud bolt of the battery terminal fixed to the battery.

7. The fusible link unit according to claim 1, wherein the fuse unit comprises a connector connected thereto, which is provided at a terminal portion of electric wires connected to equipment such that the fuse unit supplies electric power from the battery to the equipment.

8. The fusible link unit according to claim 1, wherein the fuse cover of the fuse unit is arranged so as to cover the outer circumference of the fuse unit to protect the fuse unit.

9. The fusible link unit according to claim 1, wherein the fuse cover is made of an insulative material and comprises a cover portion and a main body portion, the cover portion is arranged on the upper surface of the battery so as to cover the battery post of the battery and the battery terminal of the fuse unit, and the cover portion is coupled to the main body portion to be capable of being opened and closed via a hinge.

10. The fusible link unit according to claim 9, wherein the main body portion of the fuse cover is arranged on the upper surface of the battery so as to cover the fuse unit to accommodate the fuse unit arranged, on the upper surface of the battery, so as to protrude from a side surface of the battery based on wires for connecting with equipment, and the deck board is arranged above the fuse cover.

11. The fusible link unit according to claim 1, wherein a lower surface of the deck board and a contact surface of the fuse cover are in contact with each other and the fuse cover covers the fuse unit arranged on the upper surface of the battery in the closed state of the deck board, and the deck board is apart from the fuse cover and a space above the fuse cover arranged on the upper surface of the battery is open in an open state of the deck board.

12. The fusible link unit according to claim 11, wherein the fuse cover is arranged between the deck board and the battery such that in the closed state of the deck board, the fuse cover is fixed by being held between the upper surface of the battery and the lower surface of the deck board to prevent the generation of an abnormal sound.

13. The fusible link unit according to claim 1, wherein the fuse unit and the fuse cover are arranged to overhang the upper surface of the battery so as to protrude from a side surface of the battery.

14. The fusible link unit according to claim 1, wherein the fuse unit and the fuse cover are arranged on the upper surface of the battery so as not to protrude from a side surface of the battery.

15. The fusible link unit according to claim 1, wherein the fuse unit comprises an L-shape arranged on the upper surface and side surfaces of the battery.

16. The fusible link unit according to claim 1, wherein a lower surface of the deck board comprises a buffer material, and the fuse cover is fixed by being held between the battery and the buffer material of the lower surface of the deck board.

* * * * *